United States Patent [19]

Charles et al.

[11] Patent Number: 4,637,733

[45] Date of Patent: Jan. 20, 1987

[54] HIGH-RESOLUTION ELECTRONIC CHRONOMETRY SYSTEM

[75] Inventors: Gilbert Charles, Bures sur Yvette; Assad Assadoullah, Bagneux; Jean-Marie Bernet, Chambourcy, all of France

[73] Assignee: Commissariat a l'Energie Atomique, Paris, France

[21] Appl. No.: 734,195

[22] Filed: May 15, 1985

[30] Foreign Application Priority Data

May 17, 1984 [FR] France ..... 84 07652

[51] Int. Cl.[4] ..... G04F 8/00

[52] U.S. Cl. ..... 368/120; 364/569

[58] Field of Search ..... 368/118–120; 364/569

[56] References Cited

U.S. PATENT DOCUMENTS 4,303,983 12/1981 Chaborski ..... 364/569

4,523,288 6/1985 Hayashi ..... 364/569

FOREIGN PATENT DOCUMENTS 0092676 11/1983 European Pat. Off. .

2437648 9/1979 France .

OTHER PUBLICATIONS

Instruments and Experimental Techniques, vol. 24, No. 1, Jan./Feb. 1981, part 1, pp. 78–83, New York.

*Primary Examiner*—Bernard Roskoski

*Attorney, Agent, or Firm*—Oblon, Fisher, Spivak, McClelland & Maier

[57] ABSTRACT

An electronic chronometry system for measuring a time T between a starting instant and a stopping instant which utilizes a ramp vernier having time expansion in order to provide fine counting between a starting instant and a beginning of a clock signal and for measuring a second time between the stopping instant and a second beginning of a clock signal. The device also utilizes a rough counting device to count the number of clock periods between the beginnings of the two clock signals. The system further utilizes a compensation circuitry for determining the nonlinearity in the ramp signal in order to determine the corrective term which must be applied. The corrective term is determined during a calibration cycle as a function of the measured parameters including the first and second time periods which are measured.

8 Claims, 9 Drawing Figures

HIGH-RESOLUTION ELECTRONIC CHRONOMETRY SYSTEM

BACKGROUND OF THE INVENTION

1. Field of the Invention

The present invention relates to an electronic chronometry system involving both the time measuring process and the corresponding chronometric device. More particularly the invention relates to measuring systems exhibiting a resolution of more than 100 picoseconds.

2. Discussion of Background

Electronic chronometers for nonrepetitive phenomena, which measure the time interval between a starting pulse and a stopping pulse, often proceed by counting periods of a clock having a well known frequency. Generally, this time base circuit is constructed with a temperature-compensated high-stability quartz oscillator. Time T to be measured is then equal to $N\tau$ to within $\pm\tau/2$, $\tau$ being the clock period, N being the number present in the counter which is triggered by the starting pulse and stopped by the stopping pulse.

When a measurement resolution on the order of hundreds of picoseconds or less is desired, the time resolution of electronic counters is not sufficient, and generally the amplitude-time conversion technique is used. The starting pulse causes the starting of a sawtooth or ramp which is expressed by a voltage in the form $V=kT$ where k is a constant. The stopping pulse causes a blocking of this linear variation.

Quantification of time can be done in several possible ways. One of the most used is the multiplication of time t by a factor K, time Kt being measured by the clock counting method already mentioned.

To obtain this multiplication factor, the ramp is achieved by the charging of a capacitance C by a constant current I ($V=It/C$, the terminal voltage of the capacitance). The latter is then discharged by a current that is also constant and of well determined value i given by $i=I/(K-1)$ which give an overall time Kt for the charging plus discharging. Thus, there is produced an expansion by K of the charging time for the measurement, the resolution then being equal to $\tau/K$.

The relative precision of the ramp chronometer is, on many occasions, inferior to that of counting chronometers. Also, when long times are to be measured with a quantification on the order of some hundreds of picoseconds or less, association of a clock period counting, called main counting, and of ramp verniers are used. This technique is described particularly in the article by Ronald Nutt titled "Digital Time Intervalometer," in The Review of Scientific Instruments, vol 39, No 9, September 1968, pp 1342–1345. This process operates as follows:

The starting pulse causes the start of a ramp-shaped voltage V(t) which is stopped, at the end of time T1, by the first following clock pulse.

Since the phase between the starting pulse and the clock a priori has some value, time T1 will be between 0 and $\tau$.

Voltage V (T1) is then converted into the form of an expanded time as indicated above and is digitized (time expansion and analog-to-digital conversion).

The stopping pulse in turn causes starting of a ramp and, like the starting pulse, it is stopped by the first clock pulse that follows the end of a time T2. The stopping pulse blocks the main counter only after taking this same clock pulse into account. The counter indicates N. The time measured is then given by:

$$T=N\tau+(T1^*-T2^*)$$

$\tau$ being the clock period, T1* and T2* then being the quantified values of T1 and T2. In the case of the ramp vernier with time expansion and use of the main clock, the quantum is equal to $\tau/K$.

To avoid uncertainties resulting from chance coincidences of starting and stopping instances with the clock, and to avoid corresponding cases of ambiguity, the ramp stops are produced on the second following pulse (or on the second front of given direction, called the active front, by a clock signal formed by pulses of a certain width. The verniers thus work in a time field between $\tau$ and $2\tau$. The measurement principle remains unchanged.

When it is desired to obtain very fine time resolutions, the linearity character of the sawtooth, and of the associated digitizing, takes on great importance and it is extremely difficult to go below about a hundred picoseconds.

An aim of the invention is to escape these limitations by using a process that makes it possible to compensate for the deficiencies resulting from nonlinearity and, by so doing, to correct the measurement so that the resolution achieved is less than 50 picoseconds.

SUMMARY OF THE INVENTION

Accordingly, one object of this invention is to provide a novel system wherein the measurement error due to the nonlinearity of the ramps relates to the term (T1−T2) in the expression of T, corresponding to the fine measurement of the verniers. This term varies in the range 0 to $\tau$ by a clock period (beyond, it constitutes an increment that is taken into account by the rough counting) and represents the time phase of time T in relation to the clock. For a given time T, the value of this time phase will vary as a function of that of starting instant t1 since, a priori, the ramp deviation varies from one functioning point to the next;

It is another object of the invention to provide a system whereby, consequently, if during a calibration cycle, the starting instant t1 is made to vary in its variation range equal to clock period $\tau$, while the time interval between this instant and stopping instant t2 is kept constant, it is possible to produce a series of measurements, each tainted with the measurement error linked to starting phase t1 (the precision of the calibration is a function of the number of values selected in the range considered). Thus, it is possible to draw up a table giving the measurement error as a function of parameter T1 measured by the ramp. To escape the variations linked to second parameter T2 in the expression (T1−T2), several series of measurements are preferably made by causing time T to vary so that its phase also covers the range 0–$\tau$. Then by recording the measurement results as a function of T1 and of (T1−T2), it is thus possible to draw up a two-entry table and correct any measurement of T of the error term which corresponds to it.

According to the present invention, an electronic chronometry system is achieved by using, to measure a time T between a starting instant t1 and a stopping instant t2, fine counting means of the ramp vernier type with time expansion to measure time T1 between instant t1 and a later front of a clock signal and time T2 between instant t2 and a later clock front, and rough counting means to count the number N of clock periods of time $\tau$ between said fronts. The system is characterized in that it further comprises means for compensation of ramp nonlinearity errors to determine, in magnitude and sign, the time T to be measured, the corrective term to be applied to obtain the corrected measurement, said corrective term being determined during a calibration cycle as a function of measured parameters T1 and (T1−T2).

DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
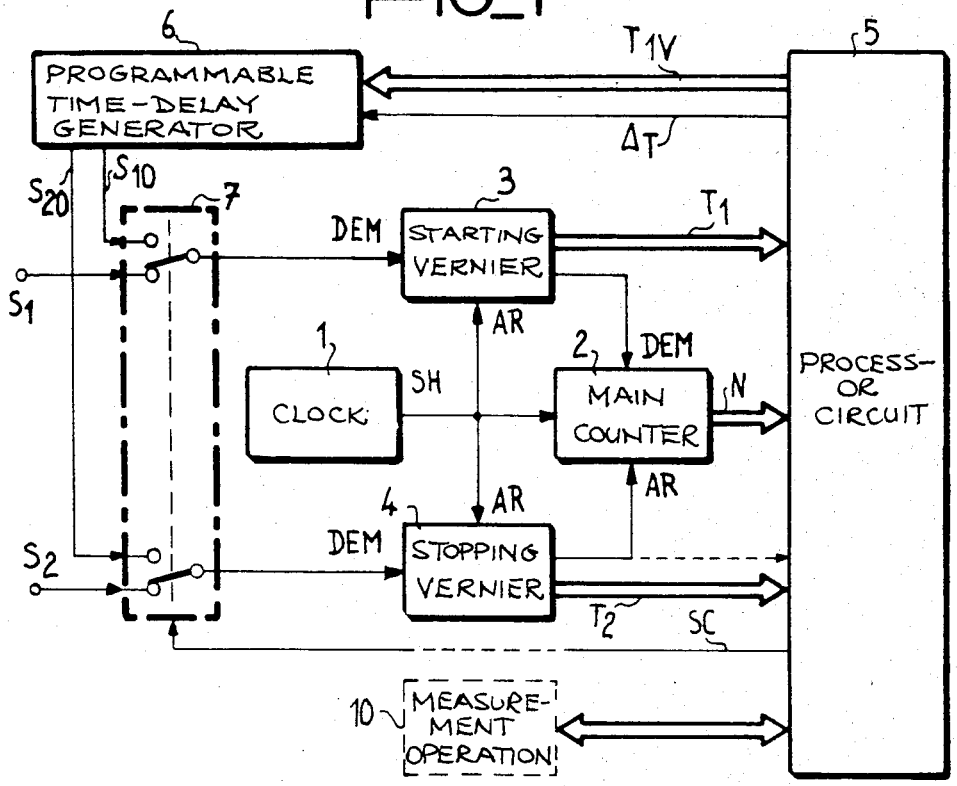
FIG. 1, details a general diagram of an electronic chronometry system according to the invention.

Referring now to the drawings, wherein like reference numerals designate identical or corresponding parts throughout the several views, and more particularly to FIG. 1 thereof, there is illustrated the main elements of the system constituting the invention. A time base circuit called clock 1 produces a clock signal SH, a main counter circuit 2 makes the rough measurement, and ramp vernier circuits 3 and 4 make the fine measurement.

Figure 2:
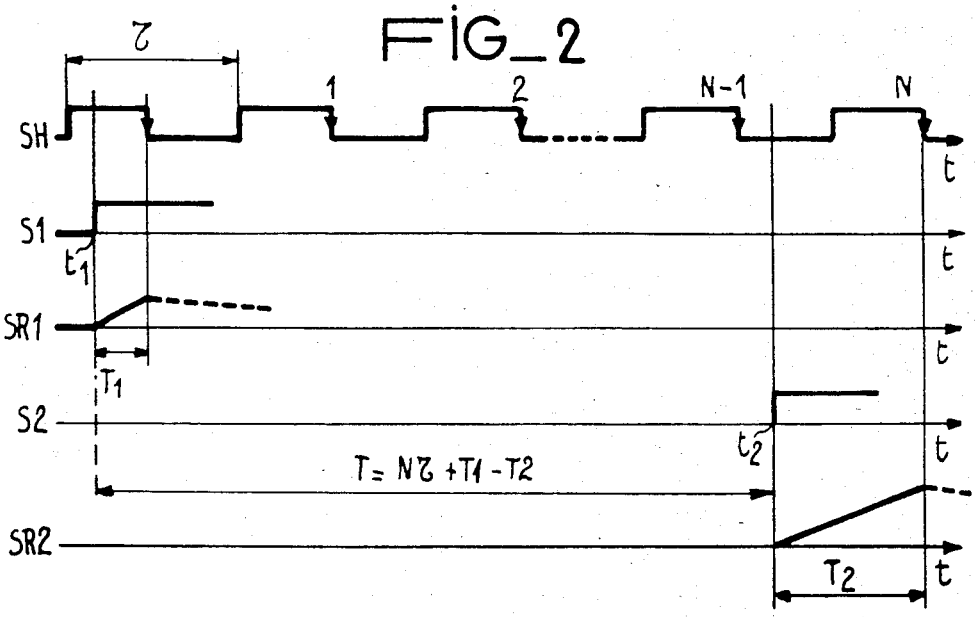
FIG. 2, waveforms relating to the functioning of the system according to FIG. 1.

FIG. 2 shows the corresponding essential signals: a clock signal SH of determined stable period $\tau$, pulses S1 and S2 which represent the starting instant and the stopping instant of time T to be measured, the ramps SR1 and SR2 of time T1 and T2 respectively. Time T is given by $N\tau+(T1-T2)$, N being the rough counting and T1 and T2 fine values obtained with time expansion. In the example shown, falling clock front SH is the active front.

According to the invention, values N, T1 and T2 which are obtained are transmitted in digital form to a control and calculating processor 5 which can consist of a microprocessor with associated read-write and read-only memories and interface circuits. Circuit 5 calculates time phase ΔT of time T in relation to the clock signal, this phase being constituted by the value (T1−T2) representing the fine measurement which exceeds the whole number N of the clock periods.

The other circuits shown consist of a programmable time-delay generator 6 and a switching circuit 7 and are used for making the calibration.

For this purpose, processor circuit 5 controls generator 6 to produce local signals S10 and S20, and switch 7 to transmit these signals to verniers 3 and 4 instead of actual measurement signals S1 and S2. Programming of circuit 5 is done to control at least a series of measurements with a constant time delay (t2−t1) between signals S10 and S20 and by causing the starting instant, i.e., the time phase of S10, to vary each time in relation to clock SH. The constant time delay, with a very great precision, is produced, 6, for example, by a circuit of temperature-compensated time-delay lines. A complete calibration cycle will comprise several series of measurements to cover variation range $\tau$ of time delay by modifying its value from one series of measurements to the next.

Figure 3:
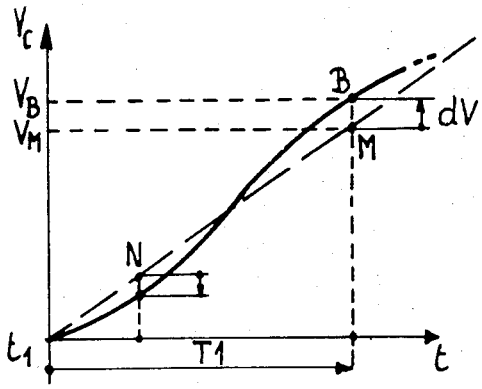
FIGS. 3–8, are variation curves showing the process used to compensate for measurement errors resulting from the nonlinearity of the ramp vernier circuits.

The measurement process used by this circuit will now be shown by FIGS. 3 to 9. In FIG. 3, it was desired to show the ramp deviation in relation to an ideal linear variation. At instant t1+T1 when the charge ceases in the starting circuit, of the vernier considered here, there is a deviation from value $V_M$ which would be obtained for a linear response, by a positive amount dV in the case considered $VB=VM+dV$. Value dV generally varies from one point to the next. It can be a positive or negative variation (for example at N). The variation is smaller when the points are closer. The response curve shown is given by way of example.

Figure 4:
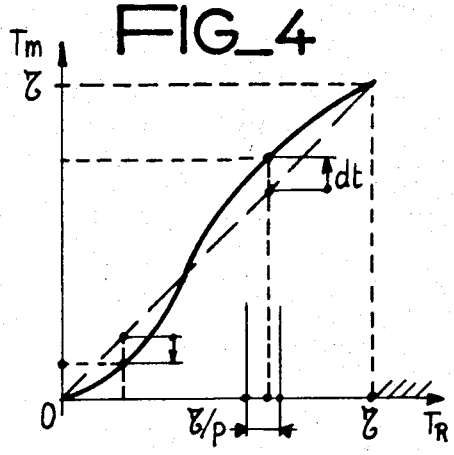

FIG. 4 is a diagram corresponding to the preceding one but transposed to time $T_m$ measured by the vernier as a function of real time $T_R$. The deviation of charge dV, which is variable as a function of the functioning point and therefore of parameter T1, which corresponds to the time phase of instant $t_1$, is replaced by the time deviation on the measurement of T1, (and of T2 for the other vernier). The time measured is in the form $Tm=T_R+dt$ or dt with sign corresponding to that of dV and an amplitude proportional to that of dV. The course of the variation of Tm is similar to that of the ramp. It is noted that, with $\tau$ being the variation range of T1 (and of T2), deviation dt is cancelled for the extreme points of $T_R=0$ and $T_R=\tau$, or for $Tm=T_R$. Curve Tm therefore is repeated for time to be measured modulo $\tau$ i.e., period $\tau$.

Figure 5:
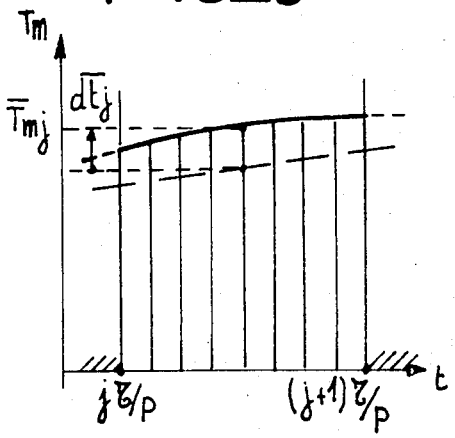
Figure 6:
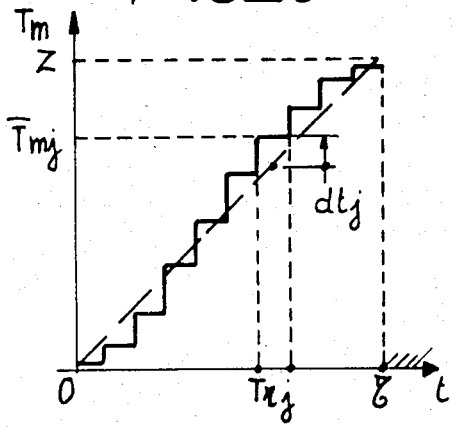

During calibration, a series of measurements are produced with $(t_2-t_1)$ equal to a constant value of R and by causing phase $t_1$ to vary to cover the range 0–$\tau$ uniformly. To do this, a determined, sufficient number of samples of regularly distributed values in the range of 0–$\tau$ can be considered. Preferably, range 0–$\tau$ is considered, cut into P slices, each of width $\tau$/P and each comprising several samples as shown in FIG. 5 for a slice Trj of any order j. The number of samples per slice is equal, or approximately equal, and the average value $\overline{T}$mj of these sample, which will characterize this slice, is determined. Thus, a distribution is obtained of P average values $\overline{T}$m1 to $\overline{T}$mP for P slices Tr1 to TrP as shown in FIG. 6, each of them distant from the theoretical linear response value by a corresponding amount $\overline{dt}_1$ to $\overline{dt}_p$ equal to the average value of deviations dt for the slice in question.

Figure 7:
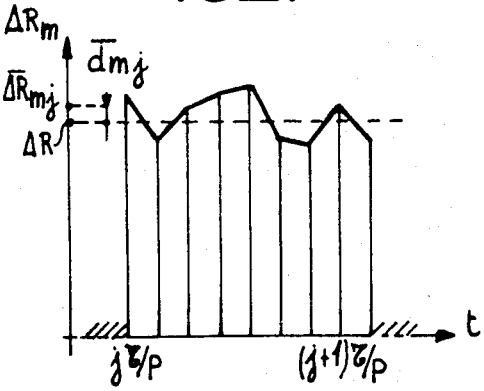

The average values $\overline{T}$m1 to $\overline{T}$mp are calculated for measured parameter T1. In the same way, for each value T1$m$ given by the starting vernier, the stopping vernier provides a measured value T2, similarly called T2$m$. The fine counting value $(T_{1m}-T_{2m})$ therefore corresponds to the theoretical value (T1−T2) tainted with measurement error dm. Assuming $T_{1m}=T_1+dt_1$ and $T2m=T2+dt2$, the measurement error dm is equal to dt1−dt2. Considering that the series of calibration measurements is made at T=constant R, the relation: $Tm=N\tau+(T_1-T_2)+dm=R+dm$ shows that: (T1−T2) is constant and equal to $R-N\tau=\Delta R$ (N being the rough counting for value R). Thus, for each measurement, processor 5 calculates the value $(T_{1m}-T_2)=\overline{\Delta R}m=\Delta R+dm$ and for each slice the average value $\overline{\Delta R}$mj which is equal to the value Δ constant R increased by the average dmj of the slice considered (FIG. 7). If now the P average values $\overline{\Delta R}$m calculated for P slices are considered, it can be considered that the average value $\overline{\Delta R}$m of the latter is defined by:

$$(\overline{\Delta R}m1+\overline{\Delta R}m2+\ldots+\overline{\Delta R}mj+\ldots\overline{\Delta R}mP)\times 1/P$$

is equal, or approximately so, to real value ΔR (FIG. 8) considering that deviations $\overline{dm}$j are small, some of positive sign, the other of negative, and of variable amplitude so that their average value is, if not zero, at least very small. The difference between this calculated overall average value $\overline{\Delta R}$m and each slice average value $\overline{\Delta R}$mj thus represents the average deviation $\overline{dm}$j of the slice considered.

Figure 8:
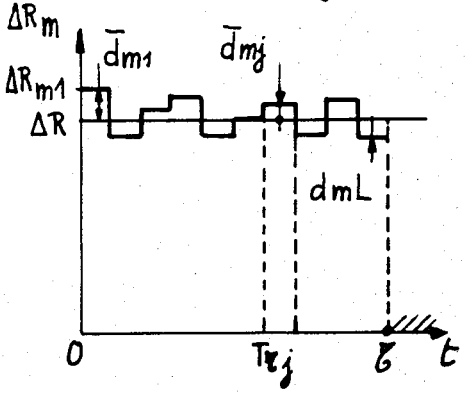

Therefore, there are obtained, by examining the results reflected by FIGS. 6 and 8, on the one hand, P average value $\overline{Tm}$j of parameter T1 covering range 0–τ in P slices of amplitude τ/P and, on the other hand, P average values $\overline{dm}$j giving the corresponding corrective term to be applied to the measurement. Consequently, for a measurement of time T the value Tm1, measured by the starting vernier, defines the location in a slice, and a table stored in memory giving $\overline{dm}$j as a function of $\overline{Tm}$j makes it possible to extract corrective term $\overline{dm}$j to be applied.

It is indeed realized that this single series of measurements applies well if period T to be measured is equal or close to the calibration value R. The more the deviation, between T to be measured and R, increases, the greater is the chance that the calculated deviation values dm will no longer correspond to the true deviation values to be applied. To escape these limitations caused by the variations of $t_2-t_1$ and therefore of the phase $\Delta T=T1-T2$ of T in the range 0 to τ, several series of calibration measurements, identical with the above ones, are made but each time the value R is changed to cover range 0–τ and thus to have the corrective term dm to be applied, whatever the value of ΔT and subsequently time T to be measured may be.

Figure 9:
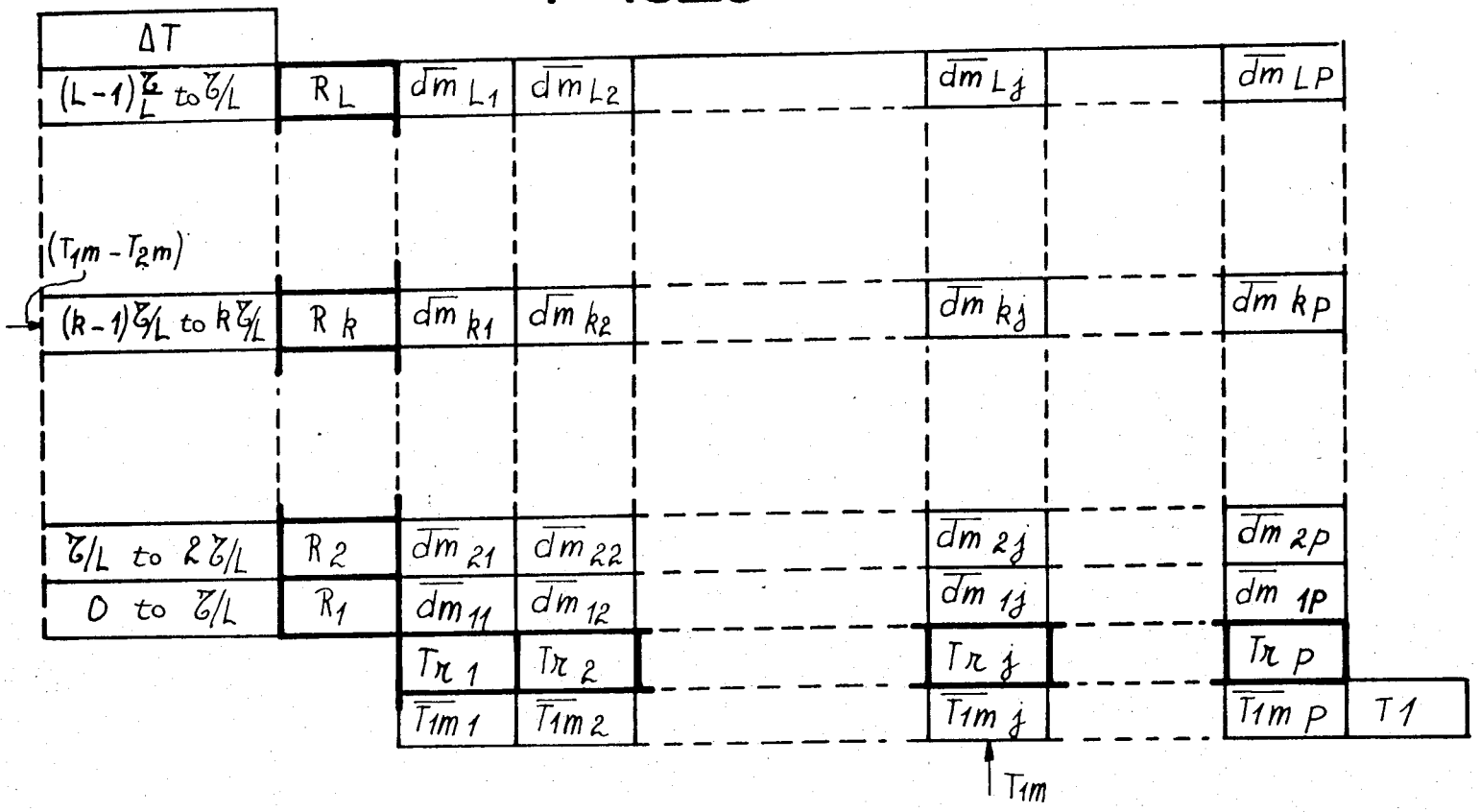
FIG. 9, details calibration recordings made according to the invention to determine a table of compensation values.

If L is the number of measurement series; the L values of R used will be designated by R1, R2, . . . $R_k$, . . . $R_L$. To have a uniform distribution, range 0–τ will be considered as regularly divided into L slices which will be called "channels" (to differentiate them from the "slices" relating to T1), each of width τ/L, each value $R_k$ being such that $\Delta R_k$ is in the middle of the corresponding slice going from (k−1)τ/L to kτ/L, i.e., $\Delta R_k=(k-1)\tau/L+\tau/2L$ approximately. For this, time delay generator 6 can be equipped with time-delay devices connected in series to give successive steps τ/L. Table FIG. 9 shows the values finally stored in the read-write memories of processor 5.

The value of T1*m* measured by starting vernier 3 indicates the slice j to be allocated, to which there corresponds no longer 1 but L values $\overline{dm}_{1j}$ to $\overline{dm}_{Lj}$ as a function of phase ΔT of time T to be measured. Corresponding calculated value $T_{1m}-T_{2m}$ defines channel k to be allocated. It is then possible to extract corrective term $\overline{dm}_{kj}$ to be applied for the measurement and to obtain the corrected magnitude which corresponds very nearly to the real magnitude of T.

By way of a practical example, with a clock of period τ=10 ns and verniers of expansion factor K=400, the fine measurement quantum is given by τ/K=25 ps, constituting the minimal possible time between samples during the calibration cycle. Under these conditions, range 0–τ will be covered by a maximum of 400 distinct values and therefore of variable phase $t_1$. By considering range 0–τ divided into 20 slices of 500 ps, or 20 distinct measurable values per slice, it is possible to decide, for example, to make 800 measurements per channel (series of measurements at constant R) to produce with a fairly uniform distribution 40 values per slice, or a 2/1 probability of producing different measurable values. With 10 channels, spaced 1 ns from each other, the complete calibration cycle will comprise 8000 measurements for the case considered. To obtain the uniform distribution of the samples in the slices, a random triggering of these measurements will be performed to cover the variation range regularly and to record a quasi-continuous spectrum of the variation of $T_{1m}$ as a function of T1. Naturally, the number of slices will be quantitatively determined, depending on whether it is possible to proceed to a large number of measurements and as a function of the fineness of the correction it is desired to achieve. The random triggering of the measurement can be produced in various ways. For example one method consists in producing at the level of the microprocessor a second local clock of a frequency different from that very stable SH delivered by circuit 1, the frequencies being chosen in an irrational ratio so that the phase presented by the active front of this local clock in regard to that reference SH is any sort, changing value practically each time. This local clock thus gives successive values T1 varying randomly.

It will be noted in the case of a random triggering that processor circuit 5 should temporarily store values T1 and T2 measured by the verniers before proceeding to sequencing by increasing order of measured values T1 then to determine the averages $T1_{mj}$ slice by slice. It will be necessary to be sure to follow values T1 and T2 of the same measurement during these operations to find in each slice (FIG. 7) values (T1−T2), called $\Delta R_m$, measured and corresponding to values $T1_m$ of this slice so that the determination of average deviation $\overline{dm}$j maintains all its meaning.

The proposed chronometry apparatus puts into practice the process that has just been described with the aid of a processor circuit 5 programmed to perform the various calculations and, during calibration, to control toggling of switches 7 to connect outputs S10 and S20 of generator 6 to the vernier circuits instead of inputs S1 and S2. The processor also controls generator circuit 6 to produce the desired series of measurements. Circuit 6 produces a starting pulse S10 and a stopping pulse S20 whose delay, in relation to the starting pulse, is of slight noise (i.e., practically without fluctuations) and is programmable over a time interval approximately equal to τ.

Figure 10:
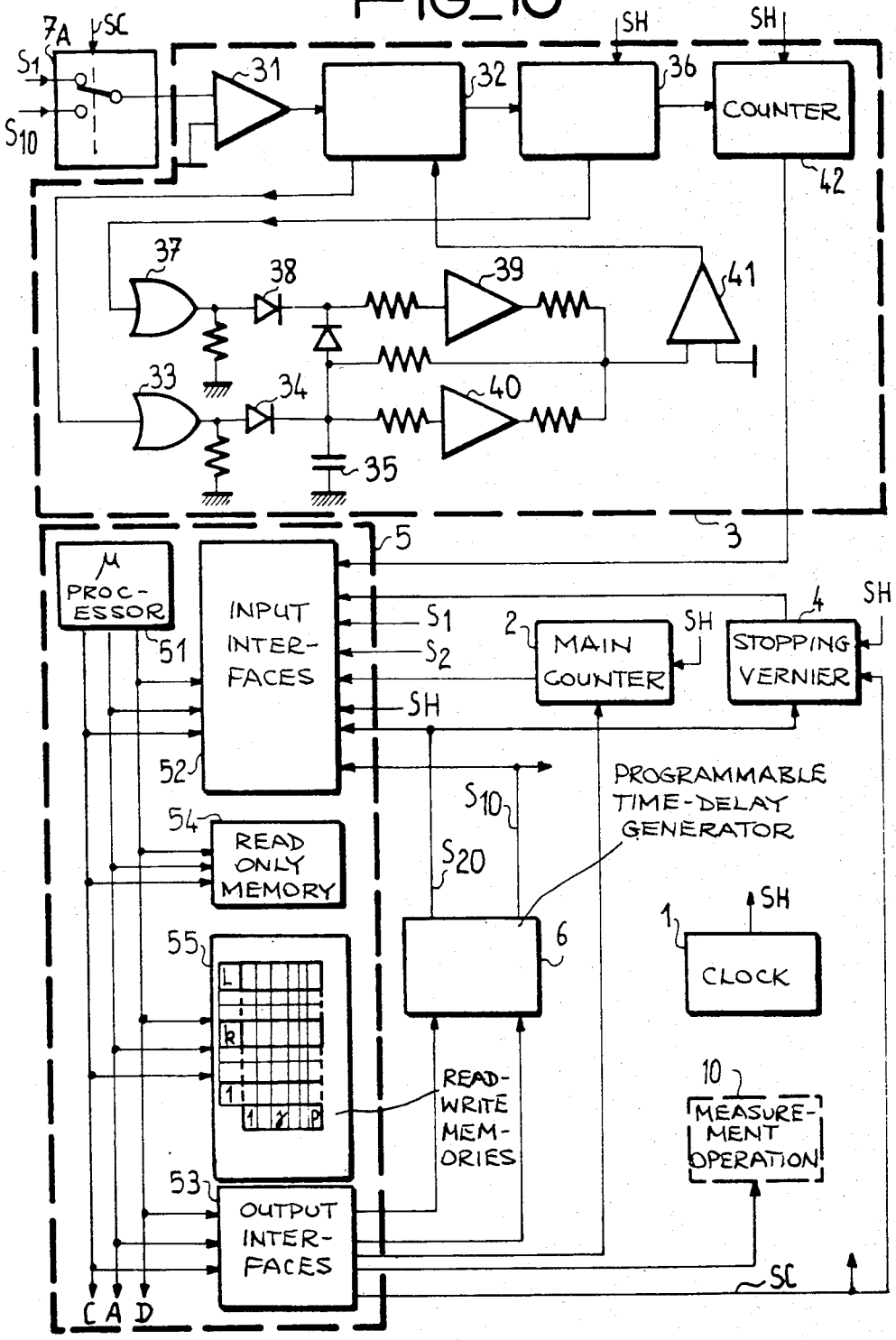
FIG. 10, is a diagram of an embodiment of the chronometry system according to the invention.

With reference to FIG. 10, a diagram of the system shows a ramp vernier circuit and the processor in more detail. Vernier circuit 3 comprises a threshold comparator 31 which produces a regeneration of input pulse S1 or S10; the following circuit 32 is a flip-flop whose change of state will control the linear charge of capacitor 35 through gate circuit 33 and diode 34. Clock signal SH then controls the discharge of capacitor 35 by circuit 36 consisting of trigger circuits and by gate circuit 37 followed by diode 38. Circuits 39 and 40 represent amplifiers. The beginning of the charge and the end of the discharge are respectively determined to obtain the desired expansion factor, for example 400 T1, due to threshold comparator 41 at output which causes circuit 32 to flop back to an initial position. Counter 42 makes the measurement of the total charge and discharge time and this information, measured in the number of clock periods SH, is transferred to processor 5 which calculates corresponding time T1. Stopping vernier 4 is constituted in a similar manner to permit calculation of T2.

Processor circuit 5 is represented according to a standard structure with a microprocessor 51, input interface circuits 52 and output interface circuits 53, read-only memory 54 and read-write memories 55 and control bus C, addressing bus A and data bus D. In the organization of read-write memories 55, there was considered an organization corresponding to that of FIG. 9 with L addressing lines according to the channel and P addressing columns according to the slice, to store the various measurement deviations $\overline{dm}_{kj}$.

Programming of processor 5 is utilized to accomplish the various successive phases of the process that was described above. This technique responds to known measurements and is relatively simple, not requiring the software to be reported here in more detail. The result of the measurement after correction is transmitted to an auxiliary operating unit 10.

Obviously, numerous modifications and variations of the present invention are possible in light of the above teachings. It is therefore to be understood that within the scope of the appended claims, the invention may be practiced otherwise than as specifically described herein.

We claim:

1. An electronic chronometry system for measuring a time period T between a starting instant $T_1$ and a stopping instant $T_2$, comprising:

a ramp vernier fine counting means having a time expansion means for measuring said first time T1 between said starting instant and a first later front of a clock signal and for measuring a second time T2 between said stopping instant and a second later clock front;

rough counting means for counting N clock periods of time $\tau$ between said first and second fronts;

compensation means for compensating for errors of ramp nonlinearity in order to determine both the magnitude and sign of a corrective term (dm) applied to said compensation means at a measured time wherein the output of said compensation means is fed to a calibration cycle means which operates as a function of said first time and the difference between said first time and said second time in order to produce a corrective value ($N\tau+T1-T2+dm$).

2. The system according to claim 1 wherein said compensation means comprises a control and calculating processor circuit and a programmable time-delay generator circuit in order to produce local signals (S10–S20) corresponding to said starting and stopping instants and to cause said first time T1 and the difference between said first time and said second time to vary during the operation of said calibration means in order to calculate the corresponding corrective term (dm) during each said time period.

3. The system according to claim 2 wherein said control and calculating processor circuit include means for controlling the time-delay generator in order to control said calibration means whereby said calibration means includes at least a series of measurements with a constant time between said local signals and wherein each said starting instant is modified to cover the variation range of said first time T1 according to a regular distribution of distinct values.

4. The system according to claim 3 wherein said variation range of said first time T1 is cut into P slices of time $\tau/P$, and wherein for each of said P slices there is calculated an average value of measured values of said first time T1 falling in said each slice and there is also calculated a second average value of corresponding values of said first time minus said second time (T1−T2) and whereby for each of said average value and said first average value there is calculated a corresponding deviation which corresponds to the corrective term to be applied for each slice as a function of said first time T1.

5. The system according to claim 4 wherein said calibration means comprises a means for providing several series of measurements L in order to determine L channels regularly covering said variation range of said second time (T1−T2) by using successive L values of time T=constant R between said local signals in order to produce an increment $\tau/L$ each time and to determine the corrective term to be applied as a function of both the value of said first time T1 and of said first time minus said second time (T1−T2).

6. The system according to claim 5 wherein said control and said calculating means further comprises a storage means to store the various values of said corrective terms to be applied according to a double-entry table as a function of said first time T1 distributed according to said P slices and as a function of said first time minus said second time (T1−T2) distributed according to said L channels.

7. The system according to any one of claims 1–6 wherein said compensation means further comprises switching means for connecting the inputs of a pair of vernier circuits to said time-delay generator during the operation of said calibration means in order to transmit two of said local signals to said verniers.

8. The system according to claim 1 wherein said compensation means includes means for modifying, during the operation of said calibration means, the phase of said starting instant in a random manner with relation to a reference clock signal.

* * * * *